US011801920B2

(12) United States Patent
Thompson

(10) Patent No.: US 11,801,920 B2
(45) **Date of Patent: *Oct. 31, 2023**

(54) LATERAL DISPLACEMENT SURF SYSTEM

(71) Applicant: Bryan Thompson, Birmingham, AL (US)

(72) Inventor: Bryan Thompson, Birmingham, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/973,056

(22) Filed: Oct. 25, 2022

(65) Prior Publication Data

US 2023/0041698 A1 Feb. 9, 2023

Related U.S. Application Data

(63) Continuation of application No. 17/217,487, filed on Mar. 30, 2021, now Pat. No. 11,524,751, which is a (Continued)

(51) Int. Cl.
*B63B 34/75* (2020.01)
*B63B 32/70* (2020.01)

(Continued)

(52) U.S. Cl.
CPC ..... *B63B 32/70* (2020.02); *B63B 1/286* (2013.01); *B63B 34/70* (2020.02)

(58) Field of Classification Search
CPC ..... A63B 69/0093; B63B 34/70; B63B 34/75; B63B 1/285; B63B 1/286

(Continued)

(56) References Cited

U.S. PATENT DOCUMENTS 7,140,318 B1 11/2006 Gasper
7,843,295 B2 11/2010 Fullerton et al.

(Continued)

FOREIGN PATENT DOCUMENTS

GB 1196863 A 7/1970
WO 2021/050569 A1 3/2021

OTHER PUBLICATIONS

Karbassi, "Vacuum Systems for Successful Implementation", Oct. 15, 2013, Robotics Tomorrow, www.roboticstomorrow.com/article/2013/10/vacuum-systems-for-successful-robot-implementation/206.

(Continued)

*Primary Examiner* — Sean D Andrish
(74) *Attorney, Agent, or Firm* — C. Brandon Browning; Maynard Nexsen PC

(57) ABSTRACT

The present disclosure generally pertains to a lateral displacement surf system and methods of laterally displacing a watercraft to generate wake. The lateral displacement system includes at least one pair of foils configured to be extended from a hull on a first side of the watercraft at a level of approximately the waterline. Upon forward movement of the watercraft with extended foils, the watercraft is rotated about its vertical axis toward the first side and generates waves sufficient for the conduction watersport activities on a second side of the watercraft. In some instances, foils are built into the hull and extended from this position, while in other instances the foils are attached to the hull using attachment structures. Rotation of the foils about an axis of rotation approximately perpendicular to a longitudinal axis of the watercraft alters the angle of attack of the foils relative to the waterline.

20 Claims, 16 Drawing Sheets

Related U.S. Application Data continuation of application No. 16/669,047, filed on Oct. 30, 2019, now abandoned.

(60) Provisional application No. 62/923,281, filed on Oct. 18, 2019, provisional application No. 62/897,578, filed on Sep. 9, 2019.

(51) Int. Cl.
*B63B 1/28* (2006.01)
*B63B 34/70* (2020.01)

(58) Field of Classification Search
USPC ..... 405/79
See application file for complete search history.

(56) References Cited

U.S. PATENT DOCUMENTS

| | | | |
|---|---|---|---|
| 7,843,296 | B2 | 11/2010 | Fullerton et al. |
| 8,339,226 | B2 | 12/2012 | Fullerton et al. |
| 8,354,909 | B2 | 1/2013 | Fullerton et al. |
| 8,373,527 | B2 | 2/2013 | Fullerton et al. |
| 8,395,467 | B2 | 3/2013 | Fullerton et al. |
| 8,534,214 | B1 | 9/2013 | Gasper |
| 8,536,966 | B2 | 9/2013 | Fullerton et al. |
| 8,539,897 | B1 | 9/2013 | Gasper |
| 8,578,873 | B2 | 11/2013 | Gasper et al. |
| 8,698,583 | B2 | 4/2014 | Fullerton et al. |
| 8,833,286 | B1 | 9/2014 | Sheedy et al. |
| 9,038,560 | B1 | 5/2015 | Brendel |
| 9,067,644 | B2 | 6/2015 | Sheedy et al. |
| 9,105,380 | B2 | 8/2015 | Roberts et al. |
| 9,150,289 | B1 | 10/2015 | Brendel |
| 9,174,703 | B2 | 11/2015 | Sheedy et al. |
| 9,199,695 | B2 | 12/2015 | Gasper et al. |
| 9,260,161 | B2 | 2/2016 | Gasper et al. |
| 9,296,447 | B1 | 3/2016 | Morgan et al. |
| 9,315,235 | B1 | 4/2016 | Wood |
| 9,315,236 | B2 | 4/2016 | Gasper |
| 9,334,022 | B2 | 5/2016 | Gasper et al. |
| 9,422,028 | B2 | 8/2016 | Wilhelm |
| 9,446,823 | B2 | 9/2016 | Sheedy et al. |
| 9,493,213 | B2 | 11/2016 | Thomas |
| 9,505,464 | B1 | 11/2016 | Wood |
| 9,540,074 | B1 | 1/2017 | Pigeon |
| 9,545,977 | B1 | 1/2017 | Swiatek |
| 9,550,551 | B2 | 1/2017 | Swiatek |
| 9,573,655 | B1 | 2/2017 | Pigeon |
| 9,580,147 | B2 | 2/2017 | Gasper et al. |
| 9,643,697 | B2 | 5/2017 | Sheedy et al. |
| 9,694,873 | B2 | 7/2017 | Gasper et al. |
| 9,796,451 | B2 | 10/2017 | Brendel |
| 9,802,684 | B2 | 10/2017 | Sheedy et al. |
| 9,834,280 | B1 | 12/2017 | Wilmoth, III et al. |
| 9,889,909 | B2 | 2/2018 | Morgan et al. |
| 9,891,620 | B2 | 2/2018 | Green |
| 9,914,504 | B2 | 3/2018 | Gasper et al. |
| 9,914,509 | B1 | 3/2018 | Tegeder |
| 9,937,984 | B2 | 4/2018 | Herrington et al. |
| 9,988,126 | B2 | 6/2018 | Wood |
| 10,059,404 | B2 | 8/2018 | Clover et al. |
| 10,183,726 | B1 | 1/2019 | McNaughton |
| 10,259,534 | B2 | 4/2019 | Sheedy et al. |
| 10,266,241 | B2 | 4/2019 | Sheedy et al. |
| 10,322,777 | B2 | 6/2019 | Gasper et al. |
| 10,358,189 | B2 | 7/2019 | Sheedy et al. |
| 10,377,453 | B2 | 8/2019 | Sheedy et al. |
| 10,386,834 | B2 | 8/2019 | Green et al. |
| D860,108 | S | 9/2019 | McNaughton |
| 11,524,751 | B2 * | 12/2022 | Thompson ..... B63B 1/286 |
| 2013/0178123 | A1 | 7/2013 | Ivory |
| 2017/0001693 | A1 | 1/2017 | Elliott et al. |
| 2018/0281906 | A1 | 10/2018 | Forrest |
| 2018/0297667 | A1 | 10/2018 | Gasper et al. |
| 2019/0152563 | A1 | 5/2019 | McNaughton |
| 2019/0210693 | A1 | 7/2019 | Spendlove |
| 2019/0210694 | A1 | 7/2019 | Forrest et al. |
| 2019/0217920 | A1 | 7/2019 | Sheedy et al. |
| 2021/0070406 | A1 | 3/2021 | Thompson |

OTHER PUBLICATIONS

Ronix Wakesurf, https://forum.moomba.com/showthread.php?27467-Anyone-seen-or-tried-Ronix-Wakesurf-Shaper-on-Moomba-boats/page7, May 7, 2016.

International Search Report and Written Opinion dated Dec. 8, 2020 received for International Patent Application No. PCT/US2020/049970, 11 pages.

International preliminary report on patentability dated Mar. 17, 2022 received for International Patent Application No. PCT/US2020/049970, 10 pages.

https://m-selig.ae.illinois.edu/ads/coord_database.html.

* cited by examiner

LATERAL DISPLACEMENT SURF SYSTEM

RELATED REFERENCES

This application claims benefit to U.S. Non-provisional application Ser. No. 17/217,487, filed on Mar. 30, 2021, titled "Lateral Displacement Surf System," which is a continuation of and claims priority to U.S. Non-provisional application Ser. No. 16/669,047, filed on Oct. 30, 2019, titled "Lateral Displacement Surf System," which claims priority to U.S. Provisional Application No. 62/897,578 filed on Sep. 9, 2019, titled "Hydrofoil System And Methods of Using Same" and U.S. Provisional Application No. 62/923,281, filed on Oct. 18, 2019, titled "Lateral Displacement Surf System," the entire contents of which are incorporated herein.

TECHNICAL FIELD

The present invention is directed to a surf system for use with watercrafts to generate lateral displacement of the watercrafts and provide surf suitable for the practice of various watersports.

BACKGROUND OF INVENTION

The practice and enjoyment of many watersports relies on the generation of wake of an appropriate size, shape, and position relative to a watercraft. These wake requirements often vary with different watersports and according to the participant's skill level, size, and preference. For example, an acceptable "surf wave" may be inappropriate or unusable for other activities, such as water-skiing or tubing. Thus, an operator of the watercraft generally desires to adjust wake as appropriate for the intended watersport and watersport participant.

One method of wake adjustment is through the use of a weighted ballast system, which results in an increase in the displacement of water due to increases in the weight of the watercraft. Displaced water is generally equal to the weight of the object that is floating or submerged in the water, so that more displacement results in a larger wave. A weighted ballast system typically includes bags that are filled with water, lead weights, or, less commonly, sand. Deployment, retraction, and adjustments to ballast systems are often time-consuming, inconvenient, and hinder the ability of the watercraft operator to quickly configure the watercraft for different watersports or participants.

The present invention presents a surf system that provides and alters wake by displacing watercrafts laterally, rather than the general downward displacement created by weighted ballast systems. In such a laterally-displaced system, the watercraft is put into a slight "yaw" position where the watercraft is pulled and rotated toward a non-surf side of the watercraft, allowing the hull to enter the water about approximately the entire length of the surf side of the watercraft, creating surf from the surf-side. By deploying or placing hydrofoils or wings on the non-surf side of the watercraft, lateral displacement is induced during watercraft movement and wake is generated. The lateral displacement surf system of the present disclosure thus generates wake through positioning and orientation of hydrofoils or wings, and wake may be quickly altered through their repositioning or reorientation, providing flexibility to a watersport participant.

SUMMARY OF THE INVENTION

The present invention is directed to a lateral displacement surf system and methods of using same. In one aspect, there is provided a lateral displacement system for generating waves. The lateral displacement system includes at least one pair of foils, each foil having a base with a front surface and a back surface, a curved wing, and an angled wing support connecting the curved wing to the front surface of the base at a wing angle. The base has at least one attachment structure on the back surface configured to attach the foil to a hull of a watercraft. Suitable attachment structures include suction cups, adhesives, and hook and pile systems, as well as systems that include mechanisms integrally formed with the hull of the watercraft including, for example, magnetic structure systems like those described in U.S. Pat. Nos. 7,843,296, 7,843,295, 8,339,226, 8,354,909, 8,373,527, 8,373,527, 8,395,467, 8,536,966, 8,698,583 and 9,105,380. Thus, when the at least one pair of foils is attached to the watercraft on a first side at a level of approximately a waterline, forward movement of the watercraft in water causes rotation of the watercraft about its vertical axis, i.e., yaw axis and generates waves sufficient for the conduction watersport activities on a second side of the watercraft. These waves exit at a rear end of the watercraft. Exemplary watercraft include powered personal watercraft such as those manufactured by Sea-Doo and Yamaha's WaveRunner-branded personal watercraft, skiffs, bass boats, ski boats, deck boats, boats that exclude or that include automatic water ballast systems, boats that exclude or include removable water bladders as ballast, sail-propelled boats, trawlers and center console boats.

To generate waves sufficient for use in watersport activities, a rear foil of the at least one pair of foils is positioned along the first side of the watercraft approximately 18 inches to approximately 36 inches from a transom of the watercraft. A front foil of the at least one pair of foils is positioned along the first side of the watercraft nearer a bow than the rear foil and the front foil is approximately 60 percent of a size of the rear foil. To maximize yaw of the watercraft, the front foil is positioned forward of the center of gravity of the watercraft, and thus, a primary function of the front foil is to cause yawing of the watercraft. To enable secure attachment of the lateral displacement system, the base is flexible and is configured to place each of the at least one attachment structures in sufficient contact with the hull for attachment to the hull.

The lateral displacement system further includes a fin mounted to the curved wing with a largest fin surface oriented approximately perpendicular to a largest curved wing surface, such that the largest fin surface is configured to be approximately parallel to the waterline when the foil is attached to the watercraft. This largest fin surface is cambered in some instances. To provide means of altering an angle of attack relative to the waterline, the curved wing is configured for movement relative to the base while the base is attached to the hull of the watercraft. This movement includes rotation of the curved wing about an axis of rotation that is approximately perpendicular to the base.

In another aspect, a second embodiment of a lateral displacement system for generating waves is provided. This second embodiment includes at least one pair of cambered wings, each wing having an upper cambered surface and a lower cambered surface, wherein the at least one pair of cambered wings is configured for extension from a hull of a watercraft. When the at least one pair of cambered wings is extended from the watercraft on a first side at a level of approximately a waterline, forward movement of the watercraft in water causes rotation of the watercraft about its vertical axis toward the first side and generates waves sufficient for the conduction watersport activities on a second side of the watercraft. These waves exit at a rear end of the watercraft.

To generate waves sufficient for use in watersport activities, a rear wing of the at least one pair of cambered wings is positioned along the first side of the watercraft approximately 18 inches to approximately 36 inches from transom of the watercraft. A front wing of the at least one pair of cambered wings is positioned along the first side nearer a bow of the watercraft than the rear wing and preferably forward of the center of gravity of the watercraft.

In some instances, the at least one pair of cambered wings is built into the watercraft and configured to be extended and retracted from the hull of the watercraft, where the extension and retraction of the at least one pair of cambered wings may be automated. To adjust an angle of attack of the at least one pair of cambered wings relative to the waterline, the at least one pair of cambered wings is configured for rotation about an axis of rotation that is approximately perpendicular to a longitudinal axis of the watercraft.

In other instances, the extension of at least one pair of cambered wings from the hull is accomplished by attaching at least one pair of cambered wings to a surface of the hull of the watercraft using at least one wing attachment structure on the at least one pair of cambered wings. To adjust an angle of attack of the at least one pair of cambered wings relative to the waterline, the at least one pair of cambered wings is configured for rotation about an axis of rotation that is approximately perpendicular to the longitudinal axis of the watercraft.

According to yet another aspect of the invention, there is provided a method of generating waves using lateral displacement of a watercraft. The method includes a first step of providing a watercraft and a lateral displacement system, where the system including at least one pair of foils. The at least one pair of foils are extended from a hull on a first side of the watercraft at a level of approximately a waterline. Following extension of the at least one pair of foils, the watercraft is moved forward in the water so that the watercraft is rotated about its vertical axis toward the first side and generates waves sufficient for the conduction watersport activities on a second side of the watercraft. These waves exit at a rear end of the watercraft.

In some instances, the extending is accomplished by attaching at least one pair of foils to a surface of the hull of the watercraft using at least one attachment structure on the at least one pair of foils. Rotating each foil of the at least one pair of foils about an axis of rotation that is approximately perpendicular to a longitudinal axis of the watercraft alters an angle of attack of each foil relative to a waterline. In other instances, the at least one pair of foils is built into the watercraft. Rotating each foil of the at least one pair of foils about an axis of rotation that is approximately perpendicular to the longitudinal axis of the watercraft alters an angle of attack of each foil relative to the waterline.

In yet another aspect of the invention, there is provided a lateral displacement system for generating waves with watercraft that include an integrally transom-mounted wing or foil, for example, as described in U.S. Pat. Nos. 7,140,318, 8,539,897, 8,578,873, 9,580,147 and 10,322,777. The lateral displacement system includes a single foil having a base with a front surface and a back surface, a curved wing, and an angled wing support connecting the curved wing to the front surface of the base at a wing angle. The base has at least one attachment structure on the back surface configured to attach the foil to a hull of a watercraft. When the single foil is attached to the watercraft on a first side, forward of the center of gravity of the watercraft and at a level of approximately a waterline, forward movement of the watercraft in water causes rotation of the watercraft about its vertical axis toward the first side, i.e., yaw, and generates waves sufficient for the conduction watersport activities on a second side of the watercraft.

A further understanding of the nature and advantages of the present invention will be realized by reference to the remaining portions of the specification and the drawings.

BRIEF DESCRIPTION OF DRAWINGS

The lateral displacement surf system and method of using same can be better understood, by way of example only, with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION OF THE INVENTION

Figure 1A:
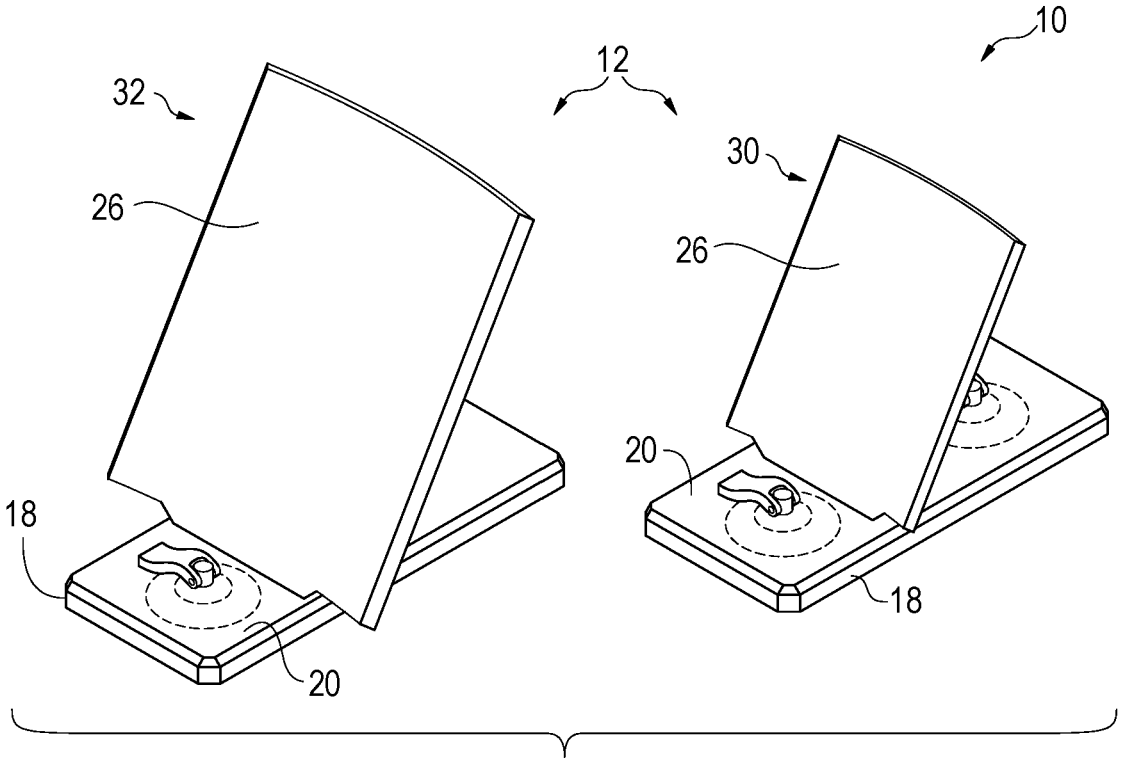
FIG. 1A-B is one embodiment of a lateral displacement system showing a pair of foils for mounting onto a watercraft and generating waves. The view is A) a front perspective view and B) a back perspective view of the foils.

The present invention is generally directed to a lateral displacement system for the generation of waves suitable for the enjoyment of watersport activities. Lateral displacement system 10 is configured to be attached to a watercraft 14, so that watercraft 14 generates waves or wake sufficient for the enjoyment of watersports, such as wakeboarding and surfing. Wake characteristics or size are enhanced by lateral displacement system 10 by allowing control of wave steepness, length, and other such wave characteristics. At least one pair of foils 12 of lateral displacement system 10 are configured to be attached to watercraft 14 at least at two points on watercraft 14, where attachment may be permanent or temporary as appropriate per application. Attachment methods and positions of lateral displacement system 10 are detailed below.

As used herein, a "foil" is an aerodynamic shape or structure that creates lift through movement through a fluid medium. When that medium is water, it is known as a hydrofoil. A wing or a cambered wing is considered to be a foil, for example. Publically available foil designs contemplated by the present disclosure are available at m-selig.ae.illinois.edu/ads/coord_database.html. No particular one of the publically available designs are necessary for success of the present disclosed invention and methods. The terms "foil" and "wing" are used interchangeably in the present disclosure.

As used herein, "forward movement" refers to movement that is at least partially directed toward the direction that the bow or front of the watercraft is facing. This movement may be relative to the flow of water about a watercraft.

As used herein, a "leading edge" is a location on the foil where the upper camber and lower camber meet, and is the closest edge in the direction that the foil is traveling.

As used herein, "lift" is not an absolute direction; rather it is a force that is the result of a foil moving through a fluid medium. Lift may be generated in any direction, depending on the orientation of the leading edge of the foil relative to the direction of motion through the fluid.

In lateral displacement system 10, at least one pair of foils 12 is positioned on a non-surf side of watercraft 14 so that watercraft 14 is in a "yaw" position when in forward motion. This positioning rotates or revolves watercraft 14 along a vertical axis 16 of watercraft 14, where a pull towards the non-surf side allows the hull of watercraft 14 to enter the water for approximately the length of the surf side. The surf side is opposite the non-surf side, so that when the at least one pair of foils 12 is placed on a starboard side, the starboard side is the non-surf side and a port side is the surf side. Similarly, when the at least one pair of foils 12 is placed on the port side, the port side is the non-surf side and the starboard side is the surf side. Surf, wake, or waves generated using lateral displacement system exit from approximately the rear, back, or stern 42 of watercraft 14. These waves extend for a wave length approximately equal to the length of watercraft 14 in many instances. In some instances, the wave length is shorter or longer than the length of watercraft 14. Lateral displacement system 10 is configured for use with watercraft 14, which is a watercraft of any size, model, shape, or manufacture, including personal watercrafts. Additionally, lateral displacement system 10 generates waves when attached to forward moving watercraft 14, where watercraft 14 is moving through a fluid, the fluid generally being water. Attachment of at least one pair of foils 12 occurs when watercraft 14 is in the fluid in some instances and before watercraft 14 is placed in the fluid in other cases.

Figure 1B:
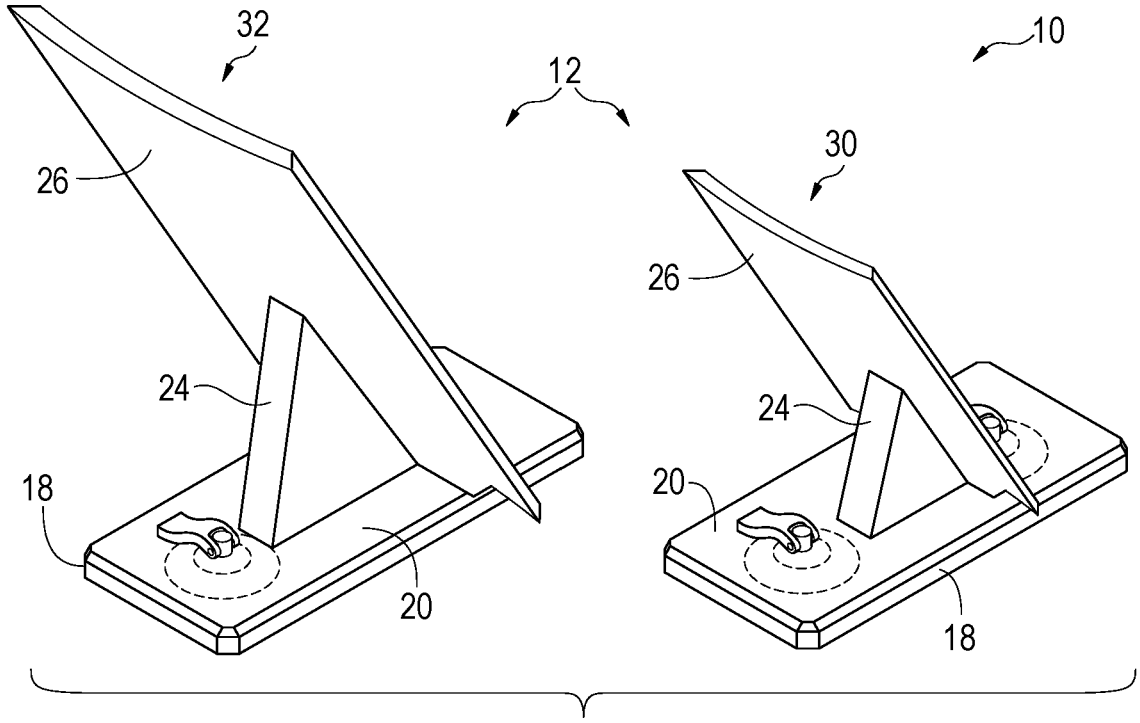
Figure 2:
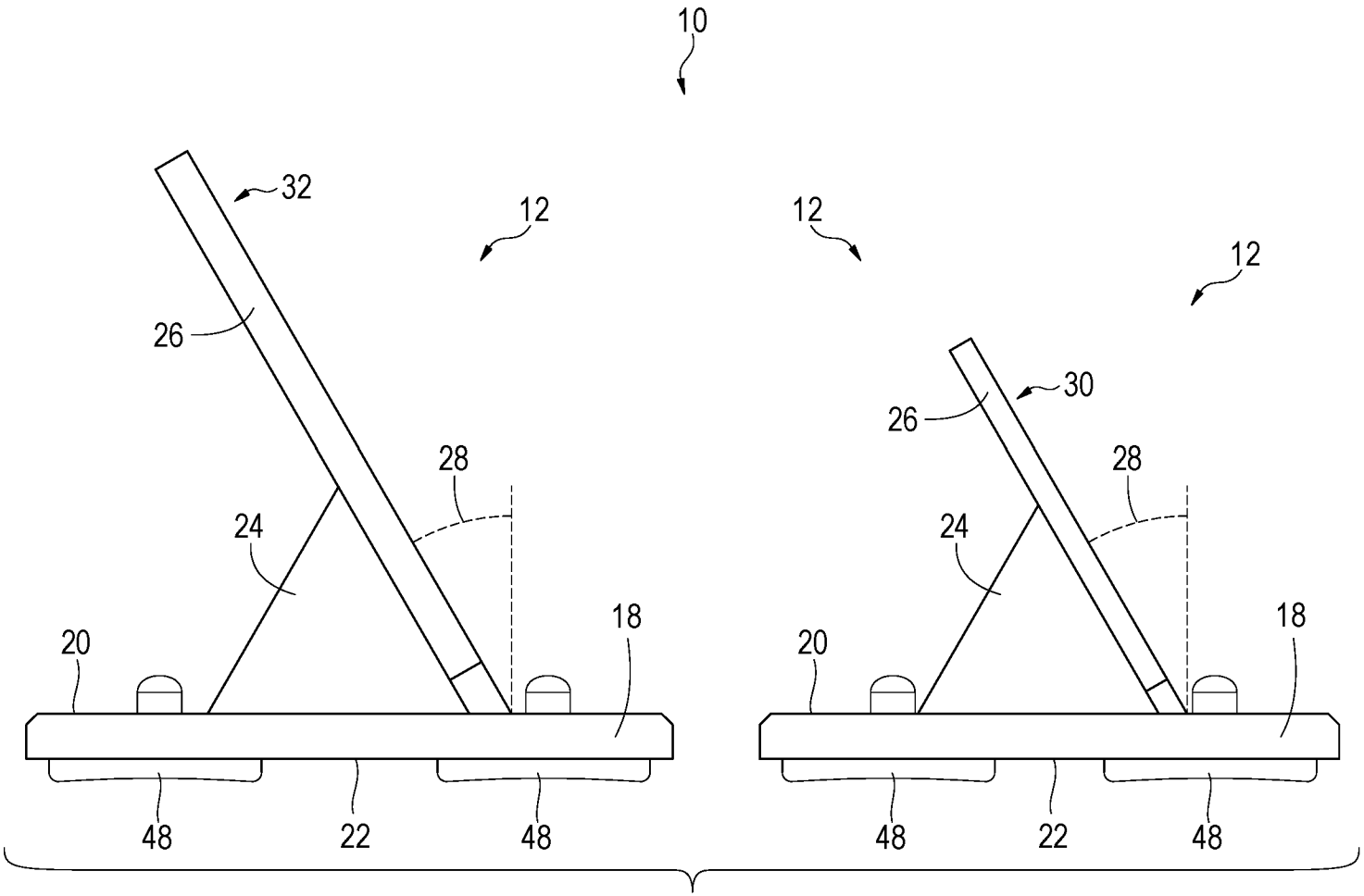
FIG. 2 is a side elevational view of the lateral displacement system of FIG. 1A-B, with wing angles visible.

Referring to FIGS. 1-2, one embodiment of the present disclosure, including at least one pair of foils 12, is displayed. In this embodiment, lateral displacement system 10 includes at least one pair of foils 12, with each foil having a base 18 for attachment to watercraft 14, base 18 having a front surface 20 and a back surface 22. Foils also include an angled wing support 24 connecting base 18 to a curved wing 26 at a wing angle 28. Curved wing 26 is positioned for the interaction with moving fluid. Features of the foils are described in further detail below. The foils of lateral displacement system 10 are composed of carbon fiber, fiberglass, or any other suitable material such that a foil shape may be constructed and such that a foil may flex without permanent deformation or failure upon application of stress during watercraft 14 movement. In some embodiments, foils are composed of a metal such as stainless steel to avoid corrosion and/or include additional materials, such as foams, to increase floatation of the foils. Components of lateral displacement system 10 may be of unitary construction or may be an assembly of several components that are attached or joined to each other by attachment means, such as joints, slots, hinges, adhesives, or other suitable joining or fastening structures, features, or materials.

An exemplary shape of the at least one set of foils 12 is shown in FIG. 1A-B, where curved wings 26 are concave, though foils may be of a different shape, such as those provided on m-selig.ae.illinois.edu/ads/coord_database.html. Foils of various shapes are contemplated for use in the present disclosure. FIG. 1A displays at least one set of foils 12 from a front side, while FIG. 1B displays at least one set of foils 12 from a back side. The concave foil design creates an extreme pressure difference with an area of high pressure forming on the uppermost portion of at least one pair of foils 12, and an extreme low pressure area on the underside of at least one pair of foils 12 when at least one pair of foils 12 is appropriately positioned on watercraft 14 and moving though fluid. The pressure difference creates lift in a downward direction through drag. The resulting downward force exerted on a hull of watercraft 14 exceeds about 1,500 lbs in some instances, depending on watercraft speed and placement of lateral displacement system 10.

Details regarding components of at least one pair of foils 12, shown in FIG. 1A-B, are herein discussed. Base 18 functions as an attachment means for foils of the at least one pair of foils 12 to be securely attached and released from positions on watercraft 14, as well as functioning as a support for the extension and orientation of curved wing 26. To achieve these functions, base 18 may be formed in various shapes, including a quadrilateral, a rounded quadrilateral, a circle, and oval, a higher order polygon, or other shapes suitable for support of curved wing 26 and attachment of the foil to watercraft 14. Thickness and size of base 18 varies based on material and application, but generally are dimensions sufficiently large enough to accommodate the size and weight of curved wing 26 and angled wing support 24 at rest and while moving through a fluid. Base 18 is likewise a sufficient size and thickness for secure attachment to watercraft 14, and presents a surface area that is generally configured to be positioned adjacent to the hull of watercraft 14 for attachment. In some embodiments, base 18 is generally rigid and in other embodiments, base 18 is an at least partially flexible base configured to conform to the hull of watercraft 14. In some instances, flexibility is achieved through a living hinge machined or constructed into base 18. In other instances, base 18 is composed of a flexible material, such as urethane rubber, neoprene-based rubber, natural gum rubber, or other such flexible materials. Additionally, flexible materials may be waterproof and UV protected materials. With such shapes, sizes, and material properties, base 18 is configured to be conformed to the hull of watercraft 14 for at least a portion of back surface 22, in both instances where the hull is relatively flat at the point of attachment and where the hull is contoured. Attachment means of base 18 are discussed below in detail.

Figure 3C:
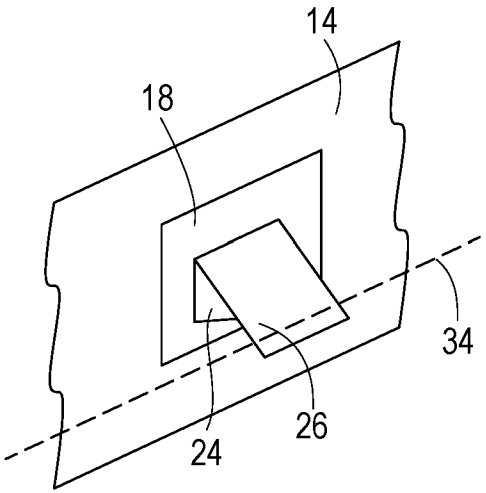
FIG. 3A-C are perspective views of a rotatable foil embodiment of the lateral displacement system of FIG. 1A-B. Foils start in A) an initial position, are then B) rotated about at an intersection of their angled wing support and bases, and C) fixed in a second position that is different from the initial position.
Figure 3B:
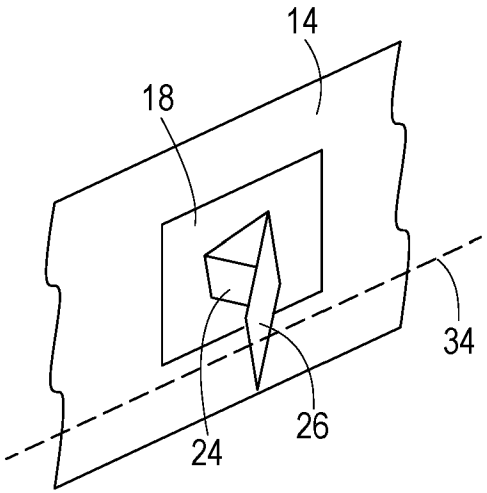
Figure 3A:
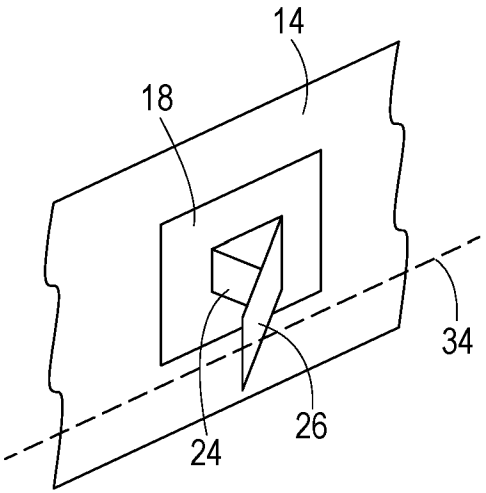

As depicted in FIG. 2, front surface 20 of base 18 presents an attachment location for curved wing 26 via angled wing support 24. Connecting base 18 to curved wing 26 is angled wing support 24, which holds curved wing 26 at wing angle 28 relative to base 18 and relative to a plane normal to base 18 at the intersection of curved wing 26 and base 18. Wing angle 28 is approximately 30° in some instances, though wing angle 18 is greater or less than 30° in other instances. Variation of wing angle 28 may change the characteristics of generated wake, where a larger wing angle 28 generates larger waves than a smaller wing angle 28 under similar conditions. Angled wing support 24 is in a shape of a wedge as depicted in the example in FIGS. 1-2, though in embodiments not shown it may be another shape or structure capable of supporting and holding secure curved wing 26 at wing angle 28. Angled wing support 24 is stationary with reference to base 18 and curved wing 26 in some embodiments, or adjustable relative to base 18, curved wing 26, or both base 18 and curved wing 26 in other embodiments. Adjustability is achieved through integration of features such as a gear, cog, a wedge and anchor, locking slots, or other means of adjustment sufficient for adjusting wing angle 28 or curved wing 26 orientation. FIG. 3A-C depicts an embodiment where curved wing 26 is adjusted by rotation of angled wing support 24 at its point of attachment to base 18. FIG. 3A shows an initial position, where curved wing 26 is oriented such that it angles inward toward watercraft 14 in the direction of bow 44 of watercraft 14. Rotation of curved wing 26 and angled wing support 24 occurs in FIG. 3B. The resulting position of curved wing 26 in FIG. 3C shows the edge of curved wing 26 that extends the greatest distance from watercraft 14 is nearest a waterline 34. In this embodiment, 360 degree rotation about an axis of rotation normal to base 18 at a point of attachment of angled wing support 24 to base 18 is possible, thus allowing the positioning of curved wing 26 in various orientations. In embodiments not depicted, wing angle 28 is adjusted by movement of angled wing support 24, and adjustment of curved wing 26 orientation is provided using the same adjustment mechanism. It is contemplated that adjustment of angled wing support 24 proceeds either before attachment of lateral displacement system 10 to watercraft 14 or after lateral displacement system 10 is already attached to watercraft 14.

Referring back to FIGS. 1-2, curved wing 26 provides surfaces for producing lift when in motion through fluid. Curved wing 26 is concave in the direction of intended water pressure during movement of watercraft 14, and convex in the direction opposite intended water pressure during movement of watercraft 14, so that the thickness of curved wing 26 is approximately even between its two faces with the larges surface area. In embodiments not shown, thicknesses vary and are not even in all locations between the two faces with the largest surface areas of curved wing 26. Curvature is variable and in some instances is greater or less than the curvature depicted in the examples in FIGS. 1-2. The shape of curved wing 26 may be square, rectangular, squoval, or any other shape suitable to provide downward lift at wing angle 28. In some instances not depicted, curved wing 26 is moved relative to angled wing support 24 and/or base 18, such that wing angle 28 and/or curved wing 26 orientation is varied. In these instances, movement occurs at an attachment point or interface between curved wing 26 and angled wing support 24, where the means of adjustment include features such as a gear, cog, a wedge and anchor, locking slots, or other means of adjustment sufficient for adjusting wing angle 28 or curved wing 26 orientation. It is contemplated that adjustment of curved wing 26 proceeds either before attachment of lateral displacement system 10 to watercraft 14 or after lateral displacement system 10 is already attached to watercraft 14.

Figure 4B:
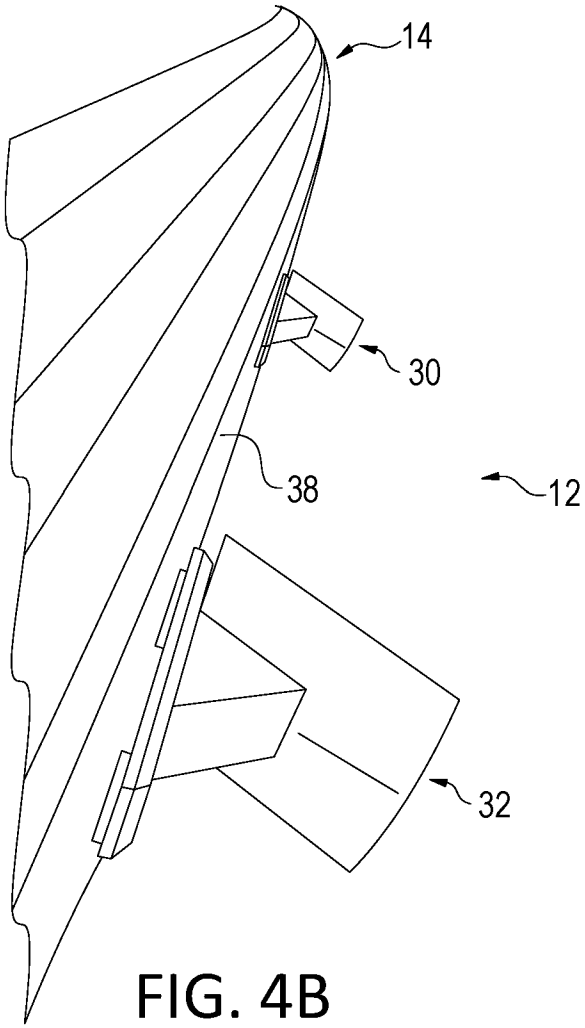
FIG. 4A-B are perspective views of foils of the lateral displacement system of FIG. 1A-B attached to the hull of a watercraft from A) a front-side perspective view and B) a rear-side perspective view.
Figure 4A:
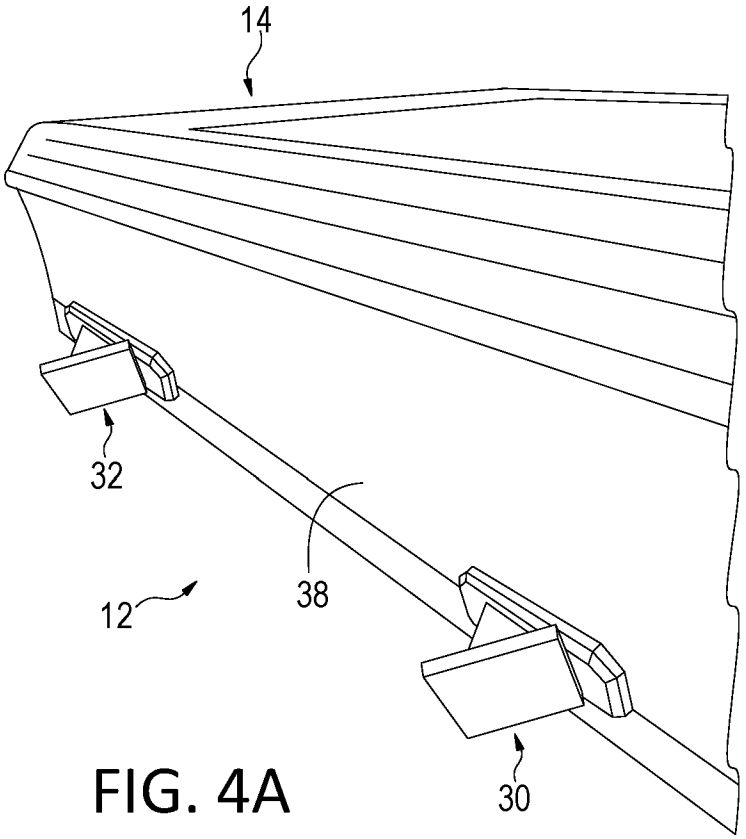

Referring to FIG. 4A-B, at least one pair of foils 12 are used in lateral displacement system 10, where a smaller, front foil 30 is approximately 60% the size of a larger, rear foil 32. Other proportions of sizes of front and rear foils 30, 32 are contemplated by the present disclosure, allowing that front foil 30 is smaller than rear foil 32. Rear foil 32 and front foil 30 are configured to be placed on watercraft 14 as a pair, though in embodiments not depicted, a single foil of a front or a rear size may be used. FIG. 4A shows the placement of at least one pair of foils 12 from a front perspective view, while FIG. 4B shows the placement from a rear perspective view. The dimensions and shape of one embodiment of rear foil 32 and front foil 30 of at least one pair of foils 12 is shown in FIGS. 1-2. In one embodiment, curved wing 26 of rear foil 32 has an exemplary length and width of 12 inches, though these dimensions may vary. For instance, these dimensions may scale according to watercraft 14 size or according to the size and shape of front foil 30 of at least one pair of foils 12. Length and width of curved wing 26 of rear foil 32 may be approximately equal or may have a length that is different from the width. In one instance, curved wing 26 of rear foil 32 has a radius of curvature of about 27.7 and is approximately 0.972 inches thick. However, higher or lower radii of curvature and thicknesses are contemplated for the present disclosure. The radius of curvature may be constant, or may vary. Similarly, the thickness may vary or be constant. Wing angle 28 of rear foil 32 is approximately 30°, though other angles are contemplated for use in the present disclosure. The ratio of lengths of base 18 to curved wing 26 for rear foil 32 and the ratio of widths of base 18 to curved wing 26 for rear foil 32 vary with application and watercraft 14. Upon attachment to watercraft 14, curved wing 26 of rear foil 32 is angled away from waterline 34 and tilted upward at an approximate 10-15 degree angle of attack 50 relative to the reference waterline 34. Other mounting angles relative to waterline 34 are contemplated.

The dimensions and shape of one embodiment of front foil 30 of at least one pair of foils 12 is additionally shown in FIGS. 1-2. Curved wing 26 of front foil 30 has an exemplary length and width of 8 inches, though these dimensions may vary. For instance, these dimensions may scale according to watercraft 14 size or according to the size and shape of rear foil 32 of at least one pair of foils 12. Length and width of curved wing 26 of front foil 30 may be approximately equal as depicted, or may have a length that is different from the width. In one instance, curved wing 26 of front foil 30 has a radius of curvature of about 13.1 and is approximately 0.895 inches thick. However, higher or lower radii of curvature and thicknesses are contemplated for the present disclosure. The radius of curvature may be constant, or may vary. Similarly, the thickness may vary or be constant. Wing angle 28 of front foil 30 is approximately 30°, though other angles are contemplated for use in the present disclosure. The ratio of lengths of base 18 to curved wing 26 and the ratio of widths of base 18 to curved wing 26 for front foil 30 vary with application and watercraft 14. Upon attachment to watercraft 14, curved wing 26 of front foil 30 is angled away from waterline 34 and tilted upward at an approximate 10-15 degree angle of attack 50 relative to the reference waterline 34. Other mounting angles relative to waterline 34 are contemplated.

Adjustment of at least one pair of foils 12 through either rotation of angled wing support 24, curved wing 26, or both angled wing support 24 and curved wing 26, results in a generally wing-like orientation, similar to a wing of an airplane, when an edge of curved wing 26 that is furthest from base 18 is positioned nearest to and oriented parallel to intended waterline 34. This adjustable wing orientation is depicted in FIG. 3A-C, and is useful in reducing the water weight that is required to produce a wave sufficient for the practice of watersport activities. In embodiments not depicted, the faces of curved wing 26 with largest surface areas have contoured surfaces, so that when curved wing 26 is positioned in an adjustable wing orientation, contoured surfaces form a cambered adjustable wing, the operation and function of which are described below.

Figure 5B:
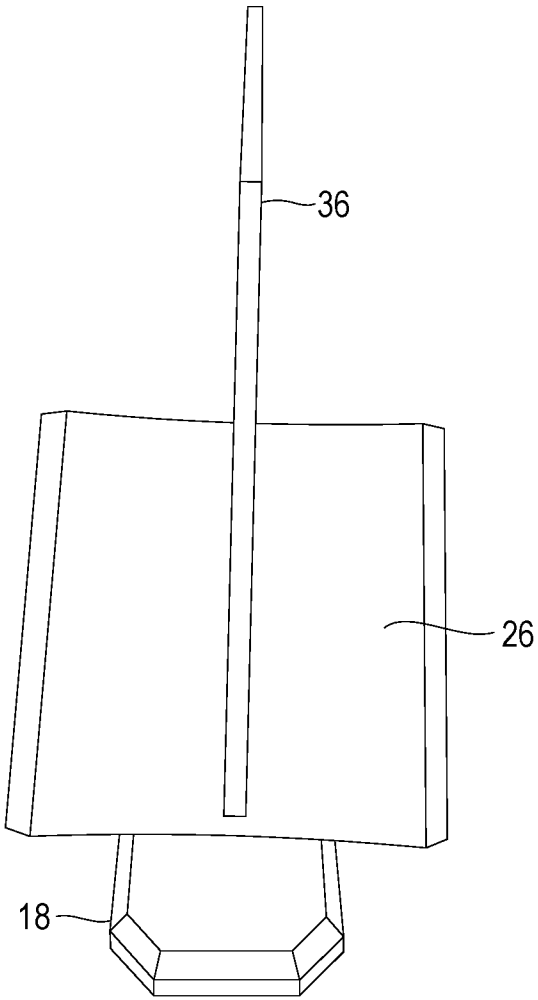
FIG. 5A-B are perspective and elevational views of a fin attached to the curved wing of the lateral displacement system of FIG. 1A-B. The finned version is shown from A) a perspective view and B) a front elevational view.
Figure 5A:
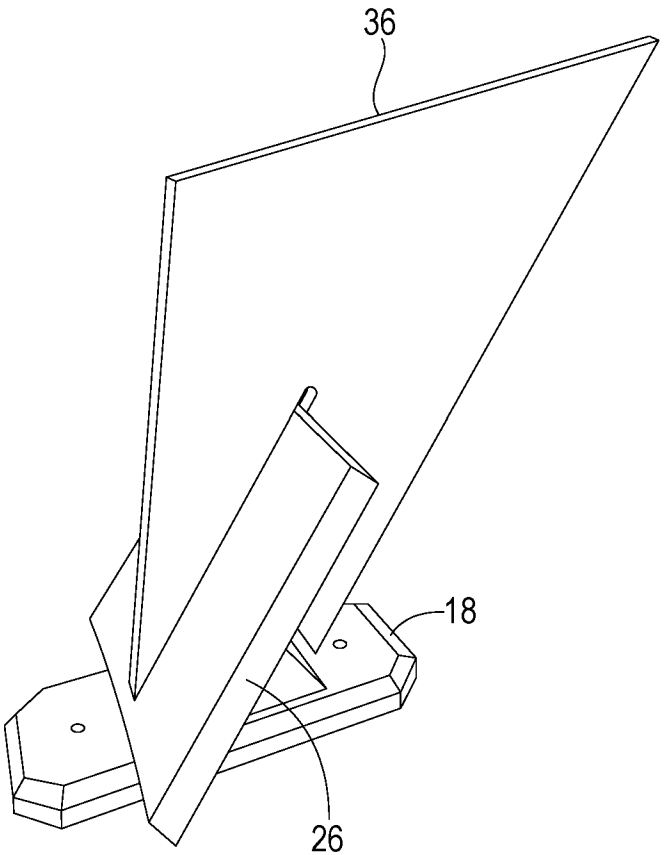
Figure 6B:
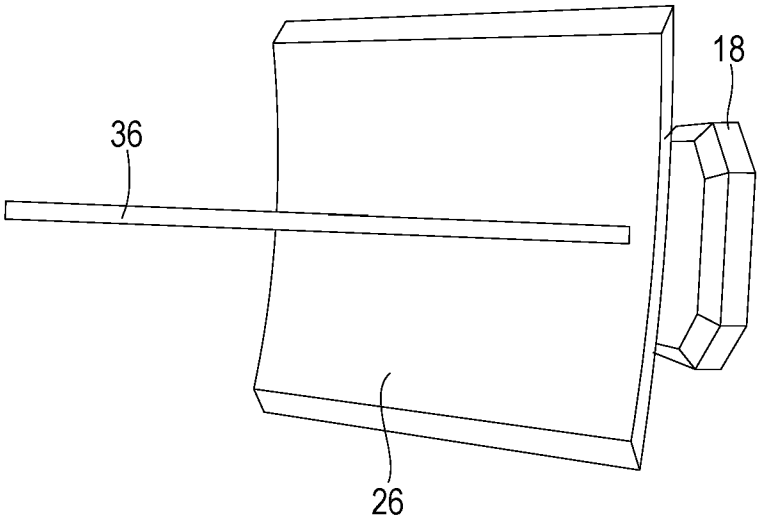
FIG. 6A-B are perspective views of a fin attached to the curved wing of the lateral displacement system of FIG. 1A-B. The finned version is shown attached A) from a level of an intended waterline from a side perspective view of the watercraft and B) as would be viewed from a bow of a watercraft looking toward a stern of the watercraft in a front perspective view.
Figure 6A:
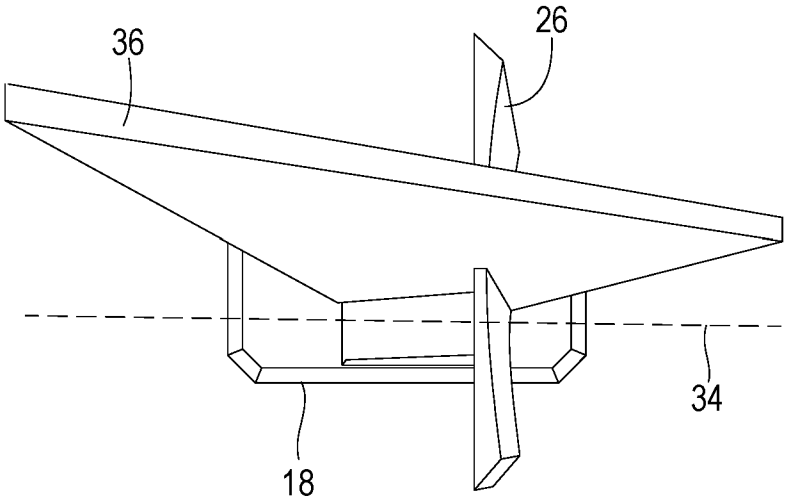

Referring now to FIG. 5A-B, a foil or foils of at least one pair of foils 12 include a fin 36 in certain embodiments, where fin 36 allows water to adhere to the surfaces of curved wing 26 and facilitate a smooth aerodynamic transition of the fluid across the faces of curved wing 26. Fin 36 also serves to "track" in the water without creating cavitation across the faces of curved wing 26 as watercraft 14 is in motion. While fin 36 is shown with its largest face having a generally triangular shape in FIG. 5A, other shapes of this largest face are possible, including a quadrilateral, a rounded polygon, an oval, a circle and any other suitable fin shape for creating a smooth transition of fluid across faces of curved wing 26. As shown in FIG. 6A, fin 36 is positioned with its largest faces perpendicular to the largest faces of curved wing 26 and parallel with waterline 34. In this position, fin 36 is generally in line with the surface of water as watercraft 14 moves through the water. Attachment of fin 36 is achieved through features or materials such as adhesives, slots, or fasteners, or other suitable attachment means in some embodiments, while in other embodiments fin 36 is of unitary construction with curved wing 26. The position of fin 36 with reference to curved wing 26 is shown in FIGS. 5B and 6B to approximately bisect curved wing 26, although fin 36 may not extend as much or may extend less across the largest faces of curved wing 26 in other instances. Similarly, fin 36 does not approximately bisect curved wing 26 in some instances, but instead may unevenly divide the largest face of curved wing 26 or may extend across curved wing 26 at an angle that is not approximately normal to the leading edge of curved wing 26. In embodiments not depicted, the faces of fin 36 with largest surface areas have contoured surfaces, so that fin 36 forms a cambered winglet, the operation and function of which are described below.

Figure 7:
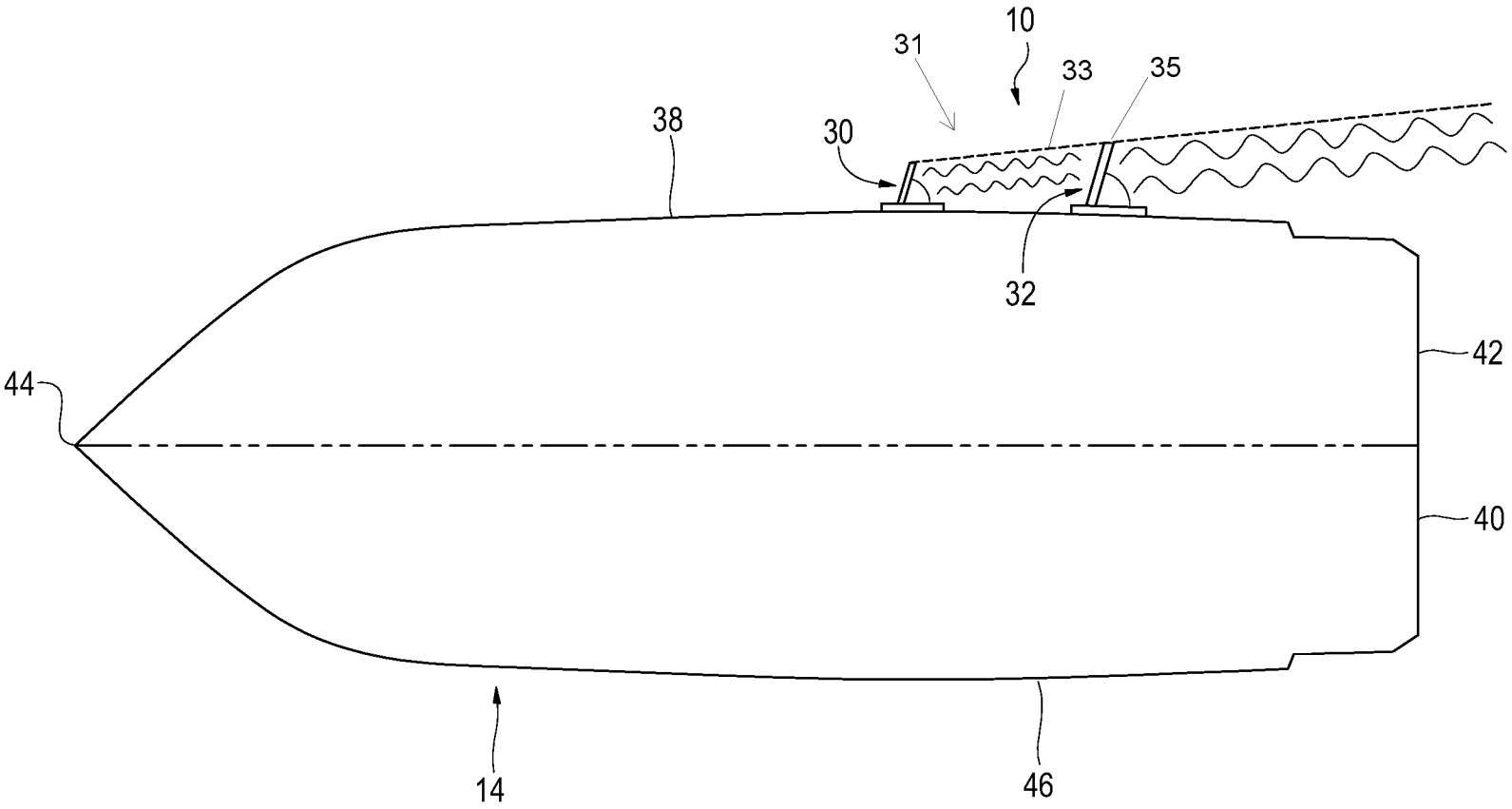
FIG. 7 is a top view of the lateral displacement system of FIG. A-B on a first side of a watercraft.

Now referring to FIG. 7, rear foil 32 and front foil 30 of at least one pair of foils 12 are attached to a hull of watercraft 14 on a first side 38, where first side 38 is the non-surf side of watercraft 14 due to placement of lateral displacement system 10 on said first side 38. While positioning of lateral displacement system 10 is shown on first side 38, other locations such as transom 40 or various locations on the hull are contemplated, such that the use of lateral displacement system 10 while watercraft 14 is in forward motion results in a "yaw" position and generation of waves. Similarly, attachment of lateral displacement system 10 to the mid-ship or sides of watercraft 14 is contemplated. To maximize yaw, one foil is placed forward of the center of gravity of the watercraft, while a second foil is located immediately forward of the transom. In instances where the "yaw" position is generated by pulling watercraft 14 toward first side 38, waves are generated on the surf-side, or a second side 46 of watercraft 14. When appropriately positioned, curved wing 26 of at least one pair of foils 12 is angled such that the largest, outward-facing surfaces of curved wing 26 face bow 44 of watercraft 14 and the surface where angled wing support 24 meets curved wing 26 faces stern 42 of watercraft 14. Thus, curved wing 26 is angled to be generally tapered inward toward bow 44 of watercraft 14.

The spacing between foils on watercraft 14 allows lateral displacement system 10 to generate turbulent flow with an exponential effect and maintains a suitable pressure differential behind the foils. In many instances such as those depicted in FIG. 8, rear foil 32 is positioned at a level of approximately waterline 34 and generally about 18 to about 36 inches from transom 40, stern 42, or rear of watercraft 14. Placement of rear foil 32 is variable based on watercraft 14 type, size, shape, and other factors, such that other locations of rear foil 32 on watercraft 14 are contemplated. Front foil 30 is similarly depicted in FIG. 8 as offset from rear foil 32 nearer a bow 44 of watercraft 14 at a level of about waterline 34. In other embodiments, front foil 30 is closer or farther from rear foil 32 when attached to watercraft 14. Generally, front foil 30 is placed approximately 12 to approximately 18 inches toward bow 44 from the center of gravity of watercraft 14. An exemplary spacing between rear foil 32 and front foil 30 is about 42 inches, though spacing varies based on several factors, including the location of the center of gravity for each watercraft 14. For instance, alternative spacing is contemplated where foil or watercraft 14 sizes and shapes alter the ideal spacing between foils. Attachment between base 18 to the hull of watercraft 14 is discussed below in detail.

Figure 9:
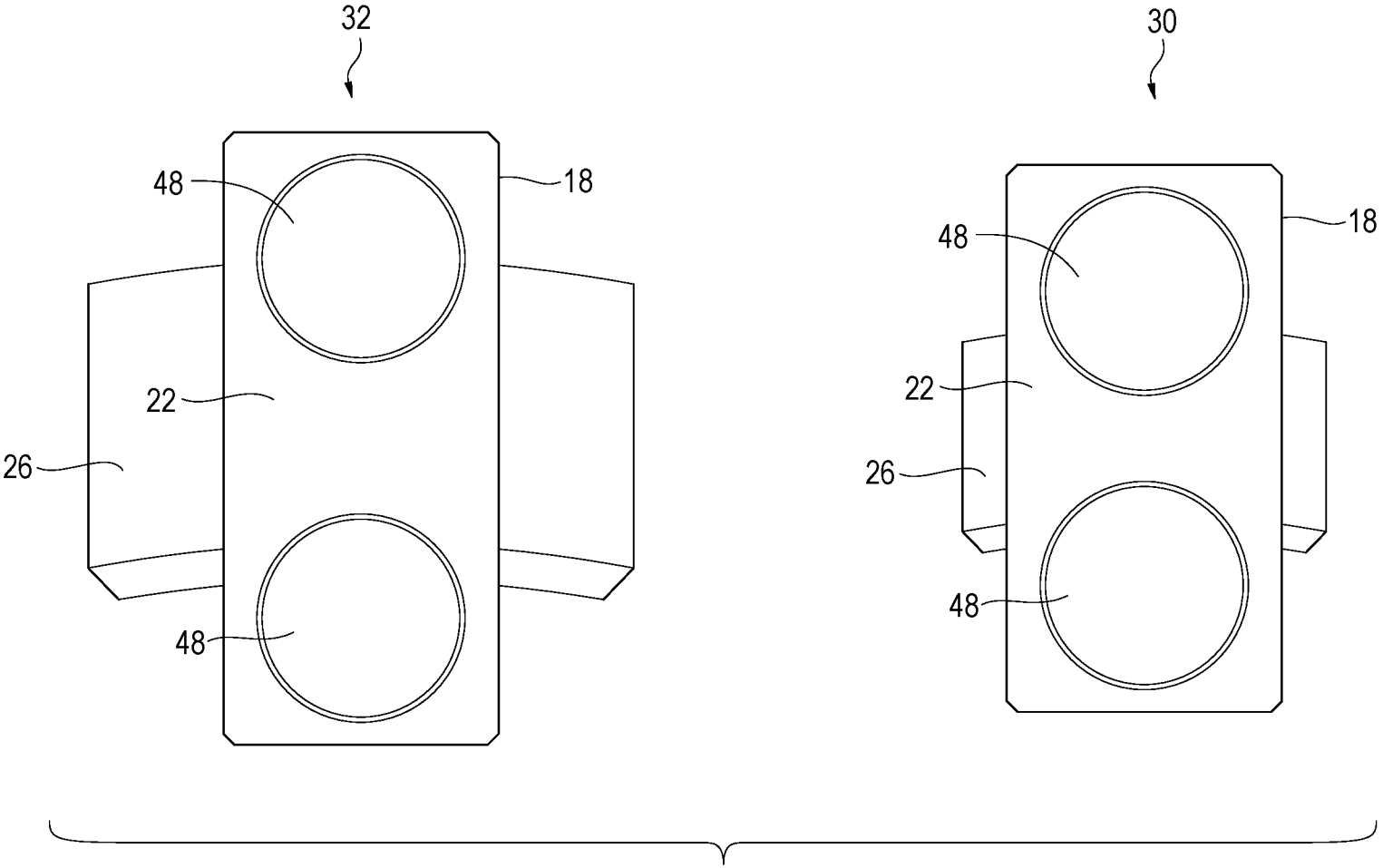
FIG. 9 is a back perspective view of attachment structures on the bases of the pair of foils from the lateral displacement system of FIG. 1A-B.

In order for lateral displacement system 10 to be attached securely to watercraft 14, a plurality of attachment structures 48 are utilized. FIG. 9 depicts attachment structures 48 on foils of lateral displacement system 10. Rear foil 32 and front foil 30 are shown with back surface 22 of base 18 facing away from curved wing 26. In instances where base 18 is composed of a flexible material or include structures for flexibility, attachment structures 48 are positioned to securely attach to the hull of watercraft 14, even when the hull is contoured or otherwise uneven. In instances where base 18 does not conform in its entirety to the hull, it is sufficient that at least attachment structures 48 are in contact with the hull. Back surface 22 includes attachment structures 48, which are shown to be suction cups in the depicted embodiment. However, other attachment structures 48, such as straps, clamps, magnets, adhesives, slots, tabs, and clips, are compatible with the present disclosure. In one embodiment, attachment structures 48 are any structure capable of reversibly attaching foils or wings of lateral displacement system 10 to the hull of watercraft 14. Attachment structures 48, in this instance, are capable of being attached to and removed from the hull without damage to lateral displacement system 10 or watercraft 14 and are capable of being located in multiple positions on the hull, as discussed above. In another embodiment, attachment structures 48 are any structure capable of permanently attaching foils or wings of lateral displacement system 10 to the hull of watercraft 14. Attachment means of lateral displacement system 10 may be built into watercraft 14 design in embodiments not depicted. Ropes, twine, or other support materials may be added to lateral displacement system 10 to assist in attachment, removal, and/or storage of lateral displacement system 10.

Use of at least one pair of foils 12 results in a lengthened wave, such that larger surfers are pushed by the wave and capable of surfing or interacting with the wave as desired. Front foil 30 is approximately 60% of the size of rear foil 32 so that front foil 30 is smaller and creates a cone of turbulence 31. The cone of turbulence 31 matches the leading face of the larger rear foil 32 and has an outer edge 33 that intersects with an outer edge of the rear foil at 35 when the foils are placed an appropriate distance from each other on the outside of the hull of watercraft 14. This spacing leads to an exponential effect on the turbulent flow generated by lateral displacement system 10.

Figure 8:
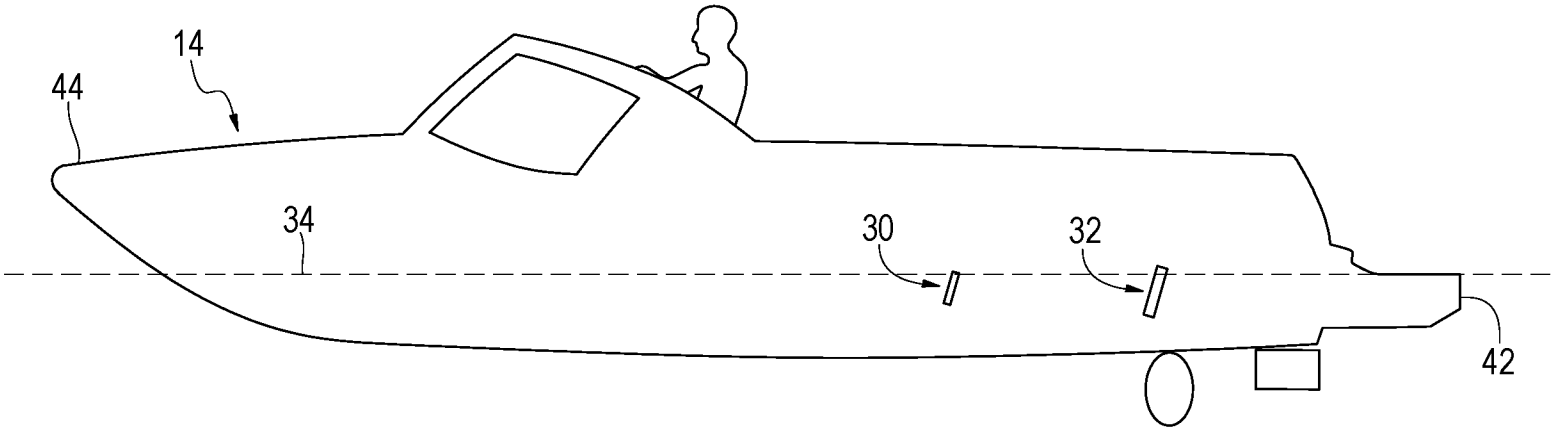
FIG. 8 is a side view of the lateral displacement system of FIG. A-B when attached to the hull of a watercraft when the watercraft is unpowered.
Figure 10:
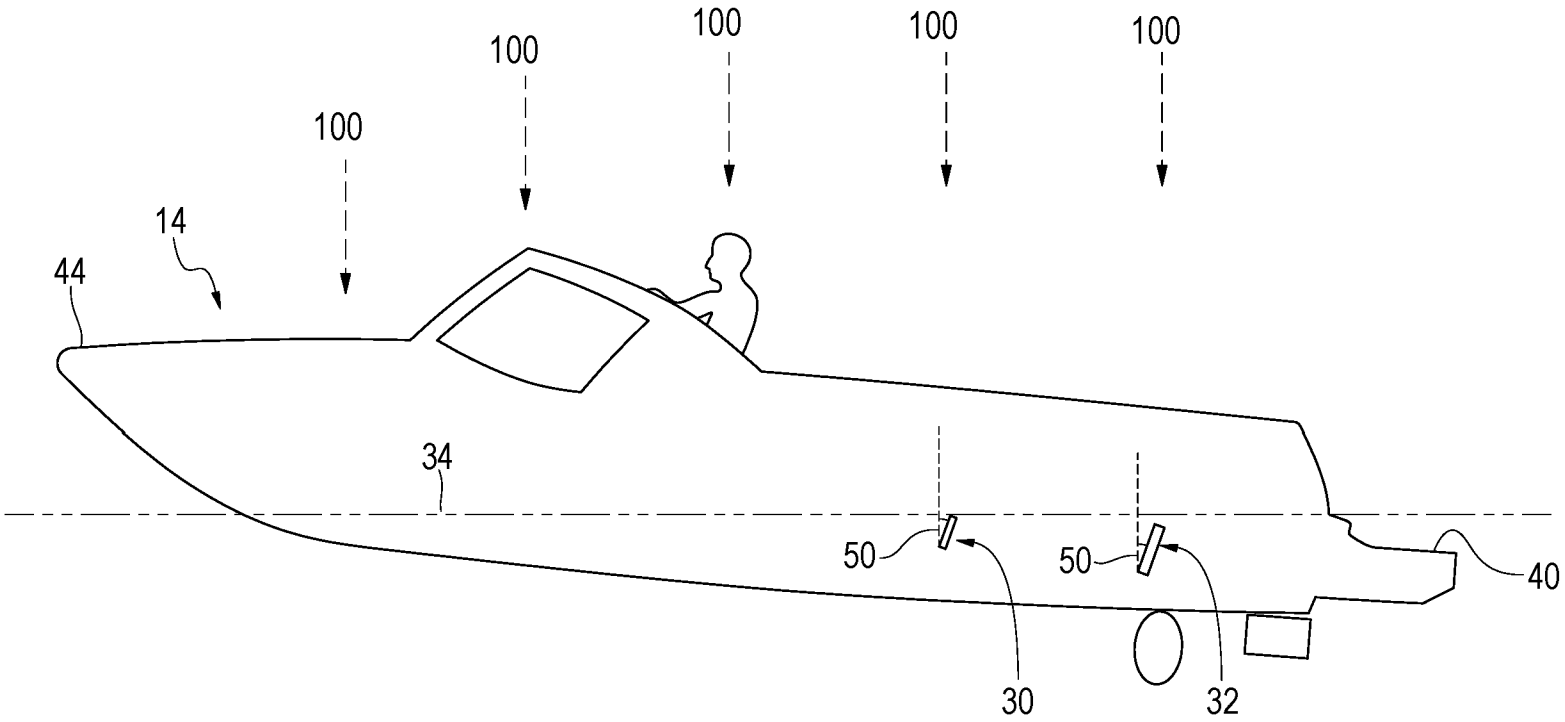
FIG. 10 is a side view of the lateral displacement system of FIG. 1A-B when attached to the hull of a watercraft when the watercraft is powered.
Figure 11:
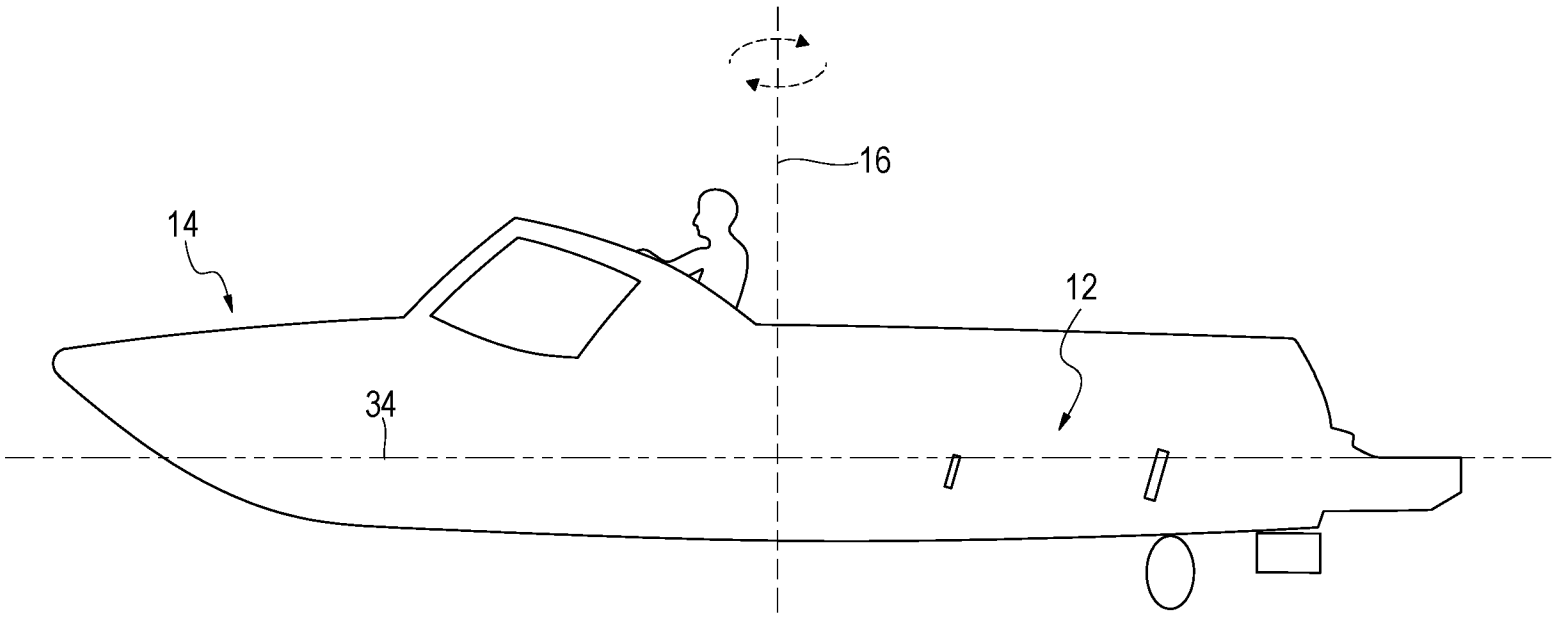
FIG. 11 is a side view of rotation of a watercraft with the lateral displacement system of FIG. 1A-B about a vertical "yaw" axis to generate waves.

Referring to FIGS. 8 and 10, the effects of lateral displacement system 10 on watercraft angle of attack 50 and lift are shown. FIG. 8 shows watercraft 14 in an unpowered state, with little or no motion relative to the flow of the water it is floating in. At least one pair of foils 12 is attached to the hull and spaced a distance from each other that depends on the watercraft and foil parameters, as discussed above. The spacing distance may be measured from similar surfaces of the foils. In the depicted example, rear foil 32 is positioned approximately 18 to approximately 36 inches from stern 42, on first side 38 of watercraft 14. In the same exemplary depiction, front foil 30 is placed on first side 38 of watercraft 14 at a longitudinal distance of about 42 inches towards bow 44 of watercraft 14 from rear foil 32. At least one pair of foils 12 is positioned at a height of approximately waterline 34, where at least a portion of the foils are beneath waterline 34. In FIG. 10, watercraft 14 is powered and in motion. When forward motion is initiated, at least one pair of foils 12 generates downward buoyant force 100 on the hull of watercraft 14. This buoyant force 100 of pushes an equal amount of water weight in the opposite direction, (i.e. foils push watercraft 14 down) and the water is forced upwards, into a wave capable of being surfed. When watercraft 14 is pushed down, angle of attack 50 combined with a deadrise is approximately 30 degrees with respect to waterline 34. Other combined angle of attack 50 and deadrise angles are possible and contemplated for use with the present disclosure. As shown in FIG. 10, the propeller may be pushed further below waterline 34 when watercraft 14 is in motion. In the exemplary depiction in FIG. 11, at least one pair of foils 12 additionally induces a "yaw" position of watercraft 14 to generate waves on second side 46, as discussed in detail above.

Referring to FIGS. 8 and 10, curved wing 26 is shown when watercraft 14 is at rest (FIG. 8) or in motion (FIG. 10). At rest, in FIG. 8, curved wing 26 is at a 15 degree angle 50 relative to waterline 34. However, when watercraft 14 is powered and in motion in FIG. 10, a total angle of attack 50 of 30 degrees relative to waterline 34 is shown. Curved wing 26 generates downward lift when watercraft 14 is in motion. The downward lift serves to push watercraft 14 downward, and likewise pushes an equal amount of water upwards, producing a wave.

Referring back to FIG. 7, downward buoyant force generated by lateral displacement system 10 is not the only effect of lateral displacement system 10, but also turbulence addition and distribution are determined. Foils of lateral displacement system 10 add turbulence into the water stream, which serves to redirect turbulent water to first side 38 of watercraft 14. In general, the propeller of watercraft 14 creates whitewash that trails behind watercraft 14. The whitewash is water infused with air. Because air is less buoyant than water, whitewash and turbulent water afford less floatation than water with less infused air.

When no lateral displacement system 10 is in place on watercraft 14, air bubbles introduced by cavitation created by the propeller exit the rear of watercraft 14 equally between two waves. Entrapped air in the waves gives the waves less "push" to propel a surfer forward. In the case where lateral displacement system 10 is attached to watercraft 14, a concentrated turbulent flow is added to the flow of water, such that the entrapped air exiting the propeller attaches to the much larger air bubble that is introduced to the flow. The resulting wave ends up having almost all of the entrapped air on first side 38 of watercraft 14. This leaves the other wake on second side 46 clean with little to no entrapped air and results in more "push", such that the surfer is capable of staying on top of the wave with greater ease.

The present disclosure creates a large area of entrapped air that stays intact through the entire length of the wave until it exits the rear of watercraft 14. Curved wing 26 is designed to flex under the water when watercraft 14 is in motion, resulting in the entrapped air bubble staying intact through the entire generated wave. Any break in the air bubble may result in turbulent flow and at least some reduction of wake quality on the "clean" side of the wave. Thus, material considerations for foils include the ability to flex and the avoidance of highly rigid materials that may result in decreased wake quality.

Figure 12:
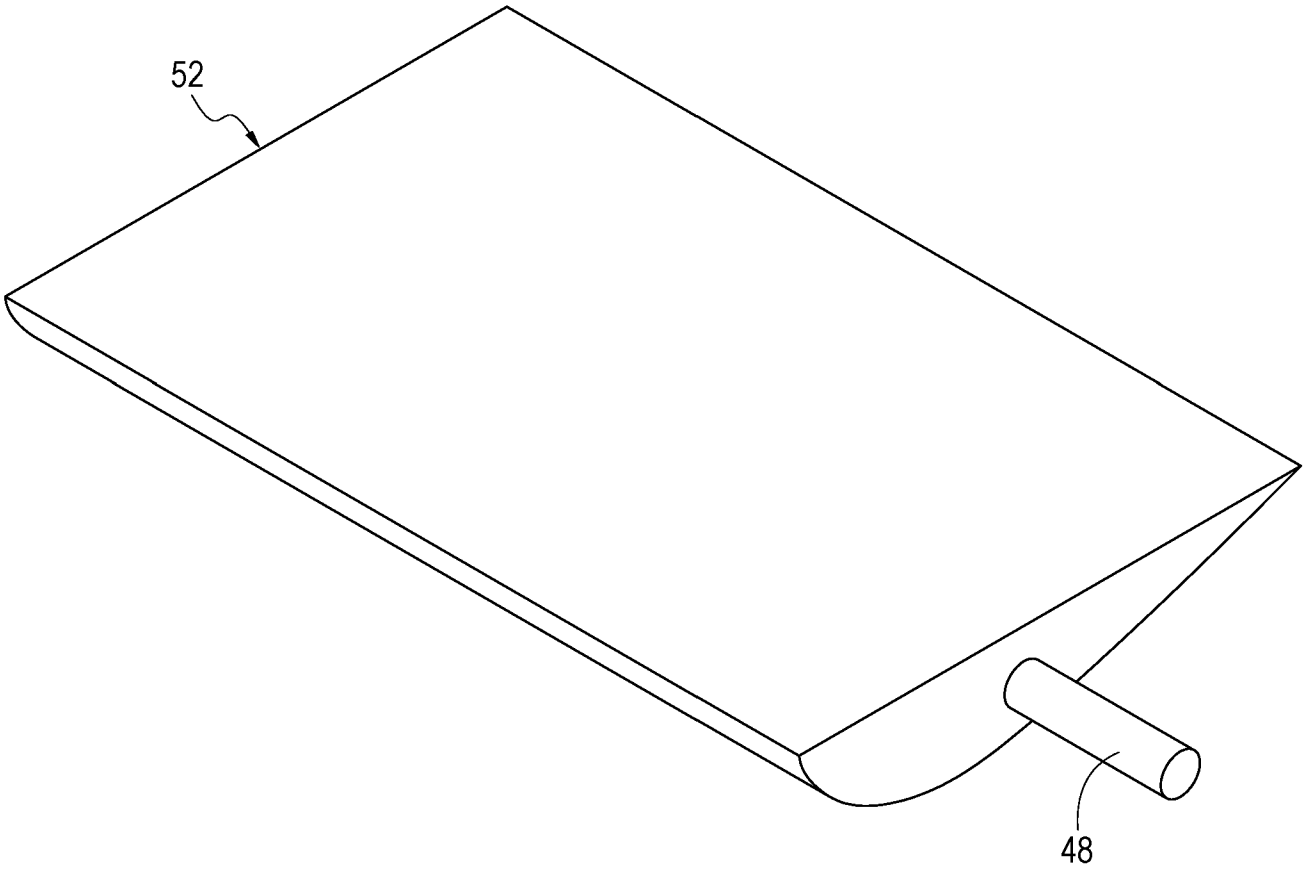
FIG. 12 is a perspective view of a second embodiment of the lateral displacement system of FIG. 1A-B with foils having a cambered wing shape.
Figure 13:
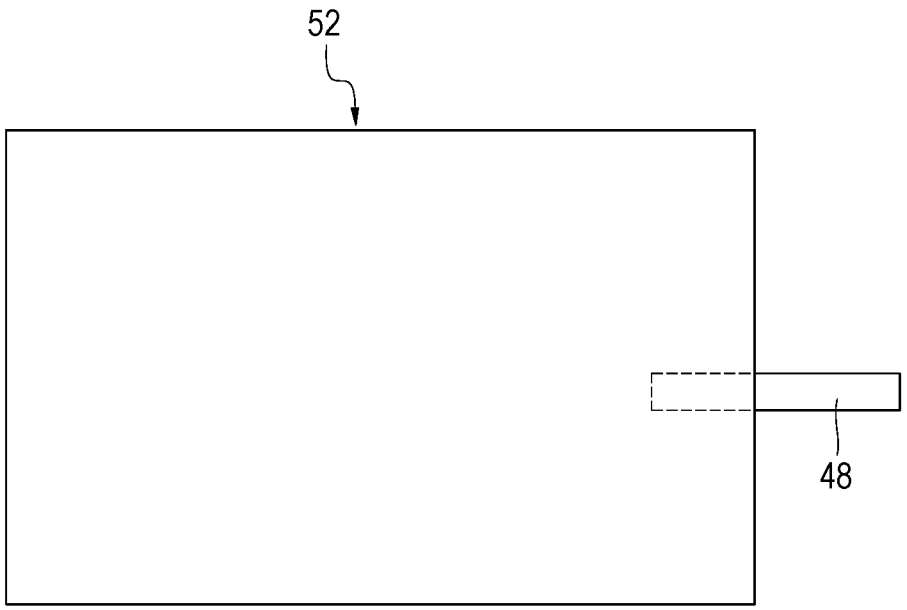
FIG. 13 is bottom view of the second embodiment of the lateral displacement system of FIG. 1A-B.
Figure 14A:
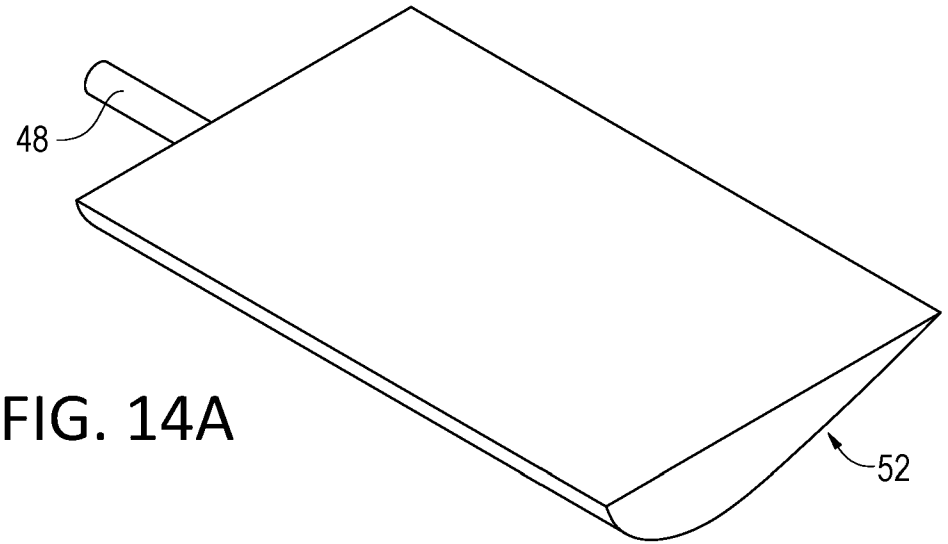
FIG. 14A-B are perspective and elevational views of the second embodiment of the lateral displacement system of FIG. 1A-B with foils having a cambered wing shape. The cambered wing is shown from A) a top-side perspective view and B) a side elevational view.
Figure 14B:
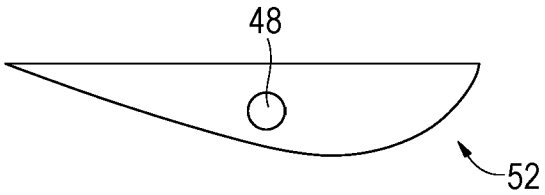

Referring to an embodiment shown in FIGS. 12-14, the foils of at least one pair of foils 12 are shaped as a cambered wing 52. In this embodiment, cambered wing 52, an example of which is depicted in FIG. 12, is utilized to generate wake when attached to watercraft 14. Cambered wing 52 is attached to the hull of watercraft 14 using attachment structure 48, which is a slot for a spoke or cylinder in the example in FIG. 13. However, attachment structure 48 may be any structure capable of attaching cambered wing 52 to an outside surface of the hull, such that wing extension and angle of attack 50 are adjustable. Cambered wing 52 has an upper cambered surface and a lower cambered surface (FIG. 14A). The upper cambered surface presents a slower moving fluid flow over cambered wing 52 than across the lower cambered surface, such that pressure is higher above cambered wing 52 and downward lift is generated when cambered wing 52 is in motion on watercraft 14. Attachment structure 48 (FIG. 14B) is located on a side adjacent to watercraft 14, when attached. The shape of cambered wing 52 is depicted with an upper cambered surface and a lower cambered surface, though the curved path may differ in embodiments not depicted. Cambered wing 52 may have any dimensions, such that it may be attached to an outside surface of the hull and generate downward lift upon forward motion of watercraft 14.

Cambered wing 52 is attached to watercraft 14 and extends perpendicularly from watercraft 14 to eliminate or reduce the need for additional ballasts due to the lift it creates when watercraft 14 is in motion. By utilizing a system that automatically controls how far cambered wing 52 is extended, as well as angle of attack 50 of cambered wing 52, the amount of downward lift can be adjusted to a wide range of values based on application requirements. The downward lift will force watercraft 14 deeper into the water, which causes the water to rise up in a direct relationship with the downward force applied by cambered wings 52. This particular application for cambered wing 52 extending from first side 38 of watercraft 14 allows the operator to change the deadrise angle at both high speed and low speed. Changing how far cambered wing 52 extends from first side 38 of watercraft 14, as well as angle of attack 50 with reference to waterline 34, allows an operator to regulate wave size and shape with a high degree of control.

For example, a front wing 56 could be angled at a 15 degree angle of attack 50, while running a rear wing 54 at a 3 degree angle of attack 50. This exemplary arrangement causes watercraft 14 to create a long, clean wave. In another instance, rear wing 54 is adjusted to a 30 degree angle of attack 50 and front wing 56 has a three degree angle of attack 50. This exemplary arrangement may result in a short steep wave. When the ability to control how far each cambered wing 52 extends from the centerline or longitudinal axis of watercraft 14, another layer of adjustability is possible. As discussed above, cambered wing structures are achievable through adjustment of a contoured embodiment of curved wing 26 and through use of a contoured fin 36, though these embodiments are not shown in FIG. 15A-B.

Figure 15A:
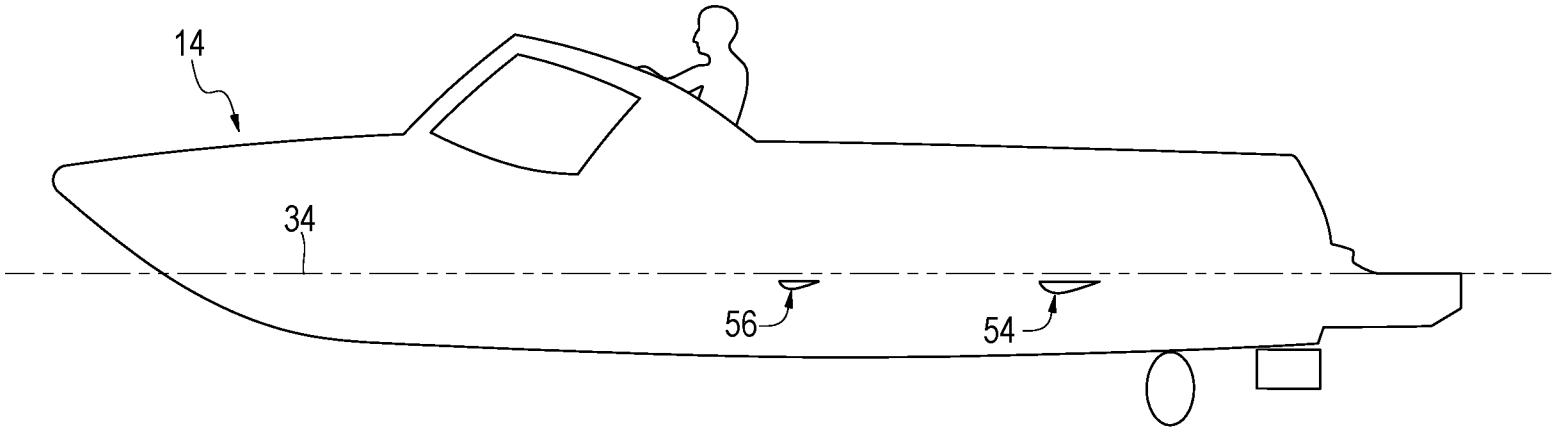
FIG. 15A-B are side views of the second embodiment of the lateral displacement system of FIG. 1A-B attached to a watercraft. The cambered wings are attached and shown in A) a view depicting the entirety of the watercraft and B) a section of the watercraft where the cambered wings are attached.
Figure 15B:
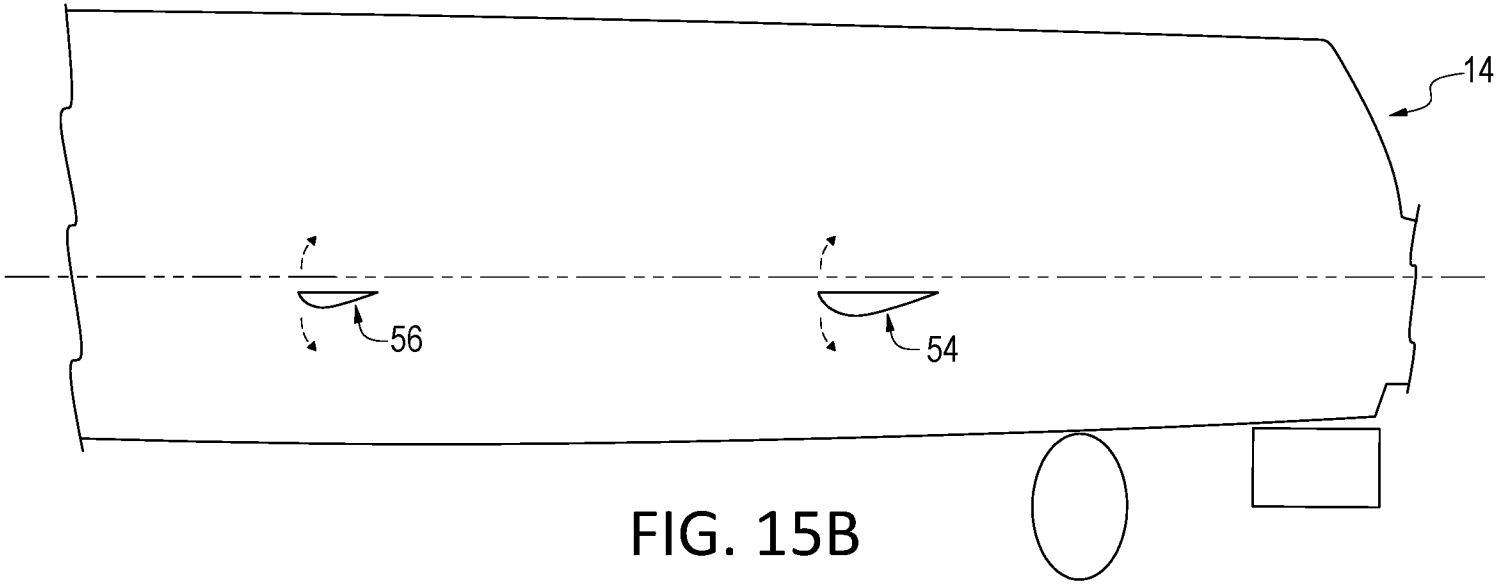

Referring to FIG. 15A-B, lateral displacement system 10 is depicted on watercraft 14 where the entire length of watercraft 14 is visible (FIG. 15A) and in an enhanced view of the sites of attachment (FIG. 15B) of a cambered wing 52 embodiment of at least one pair of foils 12. In this embodiment, lateral displacement system 10 includes at front wing 56 and rear wing 54. Each cambered wing 52 has at least one attachment structure 48, an upper cambered surface, and a lower cambered surface, where the at least one attachment structure 48 is configured to attach each cambered wing 52 to the hull of watercraft 14.

Use of both front and rear wings 56, 54 results in a lengthened wave, such that larger surfers are pushed by the wave and capable of surfing or interacting with the wave as desired. Front wing 56 is approximately 60% of the size of rear wing 54 so that front wing 56 is smaller and creates a cone of turbulence. The cone of turbulence matches the leading face of the larger rear wing 54 when the wings are placed an appropriate distance from each other on the outside of the hull of watercraft 14. This spacing leads to an exponential effect on the turbulent flow generated by lateral displacement system 10. In some embodiments not shown, front wing 56 is less than 60% the size of rear wing 54. In other embodiments not shown, at front wing 56 is larger than the size of rear wing 54. In some embodiments, front wing 56 and rear wing 54 are of substantially equal size and shape.

At least rear wing 54 and front wing 56 are attached to the hull at an appropriate distance from each other. The distance may be measured from similar surfaces of the wings and is, in some embodiments, be approximately 42 inches, though variation of spacing depends on watercraft 14 and wing size, as discussed above. Rear wing 54 is positioned approximately 18 to approximately 36 inches from transom 40 of watercraft 14. Front wing 56 is placed on first side 38 of watercraft 14 at a longitudinal distance of about 42 inches towards bow 44 of watercraft 14 from rear wing 54 in the depicted embodiment. As discussed above the spacing between front wing 56 and rear wing 54 varies based on the center of gravity of watercraft 14. Both front and rear wings 56, 54 are positioned at a height of approximately waterline 34, where at least a portion of the wings are beneath waterline 34.

Figure 16:
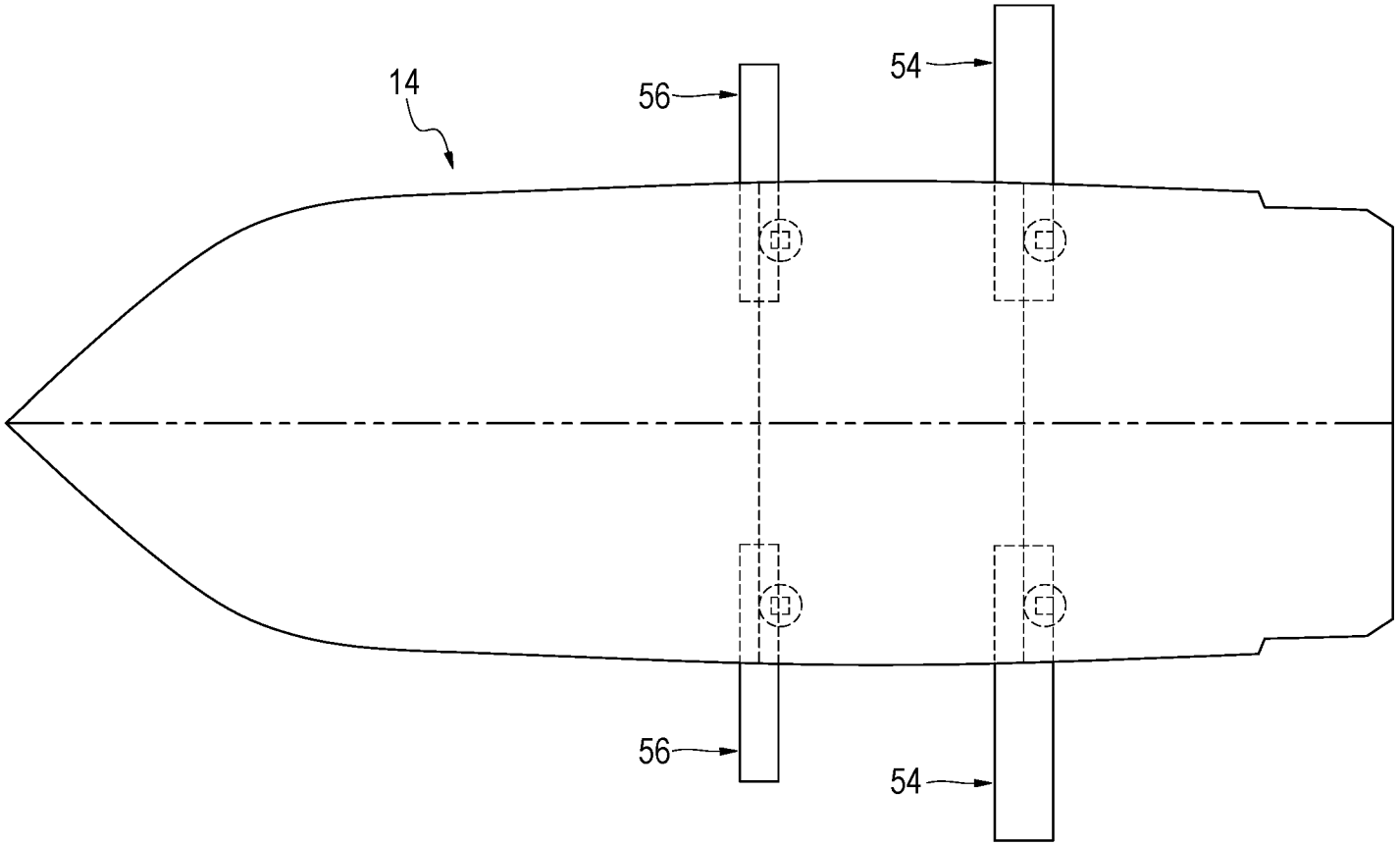
FIG. 16 is a top view of the second embodiment of the lateral displacement system of FIG. 1A-B where cambered wings are controlled, regarding extension and rotation, from the interior of the watercraft.

Referring to FIG. 16, at least cambered wings 52 are controlled regarding the extension distance from sides of watercraft 14 and regarding angle of attack 50. DC servo motors are compatible with the present disclosure to control the precise position of cambered wings 52 with regard to angle of attack 50 and waterline 34. Cambered wings 52 are capable of being mechanically deployed and extended as required. Automation parameters of cambered wing 52 extension, angle of attack 50, deployment, and retraction are controlled by an operator in watercraft 14.

For at least one pair of foils 12 of any shape, sizes, or with attachments such as fin 36 discussed herein, attachment to and extension from watercraft 14 to generate waves includes embodiments where at least one pair of foils 12 is built into watercraft 14. In these embodiments, at least one pair of foils 12 extends from a location in watercraft 14 to the exterior of the hull, such that at least one pair of foils 12 is rotatable from watercraft 14 about an axis of rotation perpendicular to the longitudinal axis of watercraft 14. Rotation of foils serves to alter angle of attack 50 and adjusts the waves generated on second side 46. Extension distance from the hull is also controlled within watercraft 14. Extension and angle of attack 50 alteration is performed manually by an operator in watercraft 14 in some instances, while in other instances this process is automated.

The present disclosure contemplates methods of inducing lateral displacement by causing watercraft 14 to be placed in a "yaw" position by lateral displacement system 10 placement, or placement of displacement features not depicted. For instance, in an embodiment not depicted, a rudder is placed on a bottom surface of watercraft 14 forward the center of gravity of watercraft 14. This rudder is a forward rudder and is smaller than the main, rear rudder of watercraft 14. The forward rudder is configured to place watercraft 14 in a "yaw" position and thus generate waves as described above using fins or foils. The forward rudder is controlled from the helm of the boat, and control is automated in some instances or manually operated in other instances.

As will be understood by those familiar with the art, the present invention may be embodied in other specific forms without departing from the spirit or essential characteristics thereof. For instance, watercraft 14 may additionally include offshore tankers, cargo ships, and sportfish boats. In another example, lateral displacement systems 10 include shapes and structures not explicitly depicted, including fins and foils of various sizes and shapes and further including rudders. Attachment, mounting, or extension locations for lateral displacement system 10 vary depending on structure used, watercraft size and shape, and activity desired to accomplish. Accordingly, the disclosures and descriptions herein are intended to be illustrative, but not limiting, of the scope of the invention which is set forth in the following claims.

What is claimed is:

1. A watercraft comprising:

a hull with a first side, and a system for altering a wake of the watercraft projecting out from the first side, the system including an elongate base having a width, a top surface, a bottom surface, a first end, a second end and a length extending between the first end and the second end, a wing coupled to the top surface, and a pair of suction cups attached to the bottom surface and detachably coupling the base to the first side, wherein the wing is configured for rotation relative to the base, and wherein the pair of suction cups includes a first suction cup located between the first end and the wing and a second suction cup located between the second end and the wing.

2. The watercraft of claim 1, wherein the base is flexible.

3. The watercraft of claim 1, wherein the wing has a width that is greater than the width of the base.

4. A watercraft comprising:

a hull with a first side, a stern, a center of gravity, a bow, and a system for altering a wake of the watercraft projecting out from and coupled to the first side and between the stern and the center of gravity, wherein the system includes an elongate base having a width, a top surface, a bottom surface, a first end, a second end and a length extending between the first end and the second end, a wing coupled to the top surface, and a pair of suction cups attached to the bottom surface and coupling the base to the first side, and wherein the pair of suction cups includes a first suction cup located between the first end and the wing and a second suction cup located between the second end and the wing.

5. The watercraft of claim 4, wherein, when the watercraft moves forward in water, the wing is configured for causing the watercraft to rotate about a yaw axis and increasing displacement of the water by the watercraft.

6. The watercraft of claim 4, wherein the wing is configured for rotation relative to the base.

7. The watercraft of claim 4, wherein the wing has a width that is greater than the width of the base.

8. The watercraft of claim 4 wherein the wing extends away from the top surface of the base in a direction of the second end thereby forming an acute angle between the base and the wing.

9. A system for altering a wake of a watercraft comprising:

a first base with a first end and a second end, the first base having a width and being configured to be detachably coupled to a side of the watercraft, a first wing attached to the first base between the first end and the second end of the base, the first wing including a first face extending between a leading end and an opposing trailing end, the leading end extending outwardly from the first base, the first face having a first surface area configured to deflect water, and the leading end being in closer proximity to the watercraft than the opposing trailing end when the system is attached to the watercraft, and a first pair of suction cups attached to the first base between the first end and the second end, wherein a first suction cup of the first pair of suction cups is attached to the first base between the first end and the leading end of the first wing and a second suction cup of the first pair of suction cups is attached to the first base between the second end and the first wing, and wherein the first pair of suction cups is configured to provide removable attachment of the first base to the watercraft.

10. The system of claim 9, wherein the first wing is configured for rotation about an axis of rotation that is approximately perpendicular to a length of the first base.

11. The system of claim 9, wherein the first face of the first wing is curved.

12. The system of claim 9, wherein the first base is fabricated from a flexible material.

13. The system of claim 9, including an angled support for supporting the first wing on the base.

14. The system of claim 9, wherein at least one portion of the first wing has a wing width that is greater than the first base width.

15. The system of claim 9, wherein the first wing is configured for rotation about an axis of rotation that extends through the first base.

16. The system of claim 9, including a second base, a second wing having a second surface area configured to deflect water attached to the second base and a second pair of suction cups attached to the second base.

17. The system of claim 16, wherein the first surface area is less than the second surface area.

18. The system of claim 16, wherein the first surface area is approximately 44% of the second surface area.

19. The system of claim 16, wherein the second wing is configured for rotation about an axis of rotation that extends through the second base.

20. The system of claim 16, wherein the first face and the first base define a first angle of attack and the second face and the second base define a second angle of attack that is different from the first angle of attack.

* * * * *